US005989056A

United States Patent [19]

Lange et al.

[11] Patent Number: 5,989,056

[45] Date of Patent: Nov. 23, 1999

[54] CABLE CONNECTOR WITH STRESS RELIEF ASSEMBLY

[75] Inventors: Ralf Lange, Meinberg; Detlef Nehm-Engelberts, Schieder-Schwalenberg, both of Germany

[73] Assignee: Phoenix Contact GmbH & Co. KG, (German Corporation), Blomberg, Germany

[21] Appl. No.: 09/011,351

[22] PCT Filed: Jul. 26, 1996

[86] PCT No.: PCT/EP96/03293

§ 371 Date: May 22, 1998

§ 102(e) Date: May 22, 1998

[87] PCT Pub. No.: WO97/06580

PCT Pub. Date: Feb. 20, 1997

[30] Foreign Application Priority Data

Aug. 4, 1995 [DE] Germany ..... 295 12 585 U

[51] Int. Cl.[6] ..... H01R 4/24

[52] U.S. Cl. ..... 439/412

[58] Field of Search ..... 439/412, 411, 439/413, 414, 404

[56] References Cited

U.S. PATENT DOCUMENTS 3,397,379 8/1968 Puig ..... 439/414

*Primary Examiner*—Neil Abrams
*Assistant Examiner*—Javaid Nasri
*Attorney, Agent, or Firm*—Charles E. Baxley, Esq.

[57] ABSTRACT

A cable connector includes a housing which supports terminal contacts which have insulation piercing devices. An insulating part can be inserted coaxially into the housing and the housing includes recesses which receive the insulation piercing devices of the terminal contacts. A union nut which can be threaded onto the housing drives the insulating part and serves to fasten and seal the entire cable connector.

6 Claims, 5 Drawing Sheets

CABLE CONNECTOR WITH STRESS RELIEF ASSEMBLY

This is a substitute specification.

BACKGROUND OF THE INVENTION

1. Field of the Invention

The present invention relates generally to the field of connectors for electrical cables and more particularly to a cable connector which incorporates insulation displacement terminals.

2. Prior Art

The prior art includes cable connectors shown in German Patents DE 31 50 568 C1 and DE 32 20 006 C1. In these devices, the axially extending recesses are arranged on the insulating part in such a way that the insulation piercing connecting devices are inserted therein lying inward and, in turn, the individual wires of the conductor cable lie pointing outward approximately parallel in the joined position. Contact can therefore be made between the cutting edges of the insulation piercing connecting devices and the individual wires essentially only in the radial direction, and for this purpose the cutting edges on the insulation piercing connecting devices are angled off outward at right angles. Pressing the individual wires of the conductor cable into the respectively associated cutting edge of the relevant insulation piercing connecting device in the radial direction is performed by projecting threads of the union nut, which either project inward more strongly with increasing screwing-on depth (DE 31 50 568 C1) or act on a finger, which is elastically deformable in the radial direction and presses, in turn, on the wires of the conductor cable (DE 32 20 006 C1). Because of the friction which occurs when the union nut is screwed on between the internal thread of the latter and the insulation of the individual wires of the conductor cable, tangential forces are produced which can cause damage to the conductor insulation or deformation of the cutting edges of the insulation piercing connecting devices, as a result of which contact is impaired. In addition, the manipulation during mounting is awkward, because the relatively stiff individual wires of the conductor cable have a tendency to come out of the outwardly open, axially extending recesses of the insulating part. It is true that this applies less in the case of the embodiment with the elastic intermediate fingers between the union nut and the individual wires, but there is still a risk in this device that the elastic fingers will lift out of the recesses in the insulating part as a consequence of the tangential friction forces occurring when the union nut is being screwed on, as a result of which reliable contact is not ensured.

German Patent DE 42 03 455 C1 shows electric plug-in connectors for a multipole terminal, which have a carrier member and a conductor guide element. The carrier member has insulation piercing connecting devices which are inserted, in the joining direction of the two parts, into recesses in the conductor guide element and whose cutting edges are likewise aligned in the joining direction. In the conductor guide element, the individual wires are positioned in obliquely extending feed-through openings such that it is possible to make contact between the cutting edges of the insulation piercing connecting devices and the individual conductor wires in the joining direction. In accordance with the envisaged multiplicity of the individual wires with which contact is to be made, a correspondingly large number of conductor guide shoulders are provided on the conductor guide element, each of which engage per se in a chamber holding the respective insulating piercing connecting device, there likewise being a corresponding multiplicity of these chambers. On the side averted from the carrier member, the conductor guide element has a corresponding multiplicity of insertion openings, it being necessary for an individual wire to be threaded into each of these insertion openings. This results in awkward manipulation. Moreover, it remains an open question as to how the extraordinarily high joining forces can be applied effectively in the case of a multiplicity of given contact points.

OBJECTS AND SUMMARY OF THE INVENTION

It is an object of the present invention to to simplify the construction of a cable connector to make it easy to assemble, and to make it possible to produce an optimum electric connection even in the case of different cross-sections of the individual wires of the conductor cable which are to be connected and/or of their different insulating thickness.

Another object of the present invention is to provide a cable connector in which the cutting edges of insulation piercing connecting devices are aligned axially or virtually axially in the single holding bore of a housing part.

The foregoing and other objects and advantages of the present invention will appear more clearly hereinafter.

In accordance with the present invention there is provided a cable connector in which a housing part, which has an axial holding bore and a number, corresponding to the number of the individual wires of the conductor cable that are to be connected, of terminal contacts, which on the cable side have insulation piercing connecting devices with cutting edges arranged in the holding bore. Furthermore, the cable connector has an insulating part which can be inserted coaxially into the holding bore and has axially extending recesses for inserting the insulation piercing connecting devices of the housing part, accompanied by making contact with the individual wires. A union nut, which can be screwed onto the housing part of the cable connector while driving the insulating part, serves to fasten and seal the entire cable connector.

Cutting edges of insulation piercing connecting devices are aligned axially or virtually axially, in the holding bore of the housing part and starting from an insertion opening for the individual wires of the conductor cable, the insulating part has obliquely extending feed-through openings for respectively feeding through an unstripped individual wire. In addition, the feed-through openings cross the recesses which have been formed for inserting the cutting edges of the insulation piercing connecting devices and hold the individual wires in a position required for making contact with the cutting edges of the insulation piercing connecting devices. Furthermore, anti-slip means for the respectively inserted individual wire are provided on the obliquely extending inner contour of the feed-through openings. A coding device for positioning the insulating part with respect to the insulation piercing connection devices is arranged between the insulating part and the housing part.

A key feature of the invention is that a particularly simple and expedient configuration of the entire cable connector is produced, which makes it possible for the individual wires to be introduced and spread out into the pluggable insulating part and, moreover, into the assigned insulation piercing connecting devices which are arranged in the single holding bore of the housing part without a need for a special tool. At the same time, the result is that stress is relieved on the individual wires and thus on the conductor cable, and that the entire cable connector is encapsulated against the intrusion of dust and moisture, and this is achieved in a single work operation. Ring seals are provided for this purpose between the union nut and the housing part which close and seal axially and radially, or, alternatively, a crown-shaped pressure member and, furthermore, a cylindrical flexible seal which can be displaced axially on the outer insulation of the conductor cable. The cable connector according to the invention is suitable chiefly for a standard round cable which can be rotated easily per se in the circumferential direction and is correspondingly difficult to manipulate.

In the housing part or housing flange, which can preferably be plugged or screwed in, the connecting electrodes are aligned axially parallel relative to one another, and arranged at equal distances from one another, and they are positioned with their insulation piercing connecting devices and their cutting edges, which sever the insulation, so deep in the housing part that they are shockproof and cannot cause injury. The outer contour of the housing part or of the housing flange preferably has, at least towards both ends, a cylindrical shape with an external thread. Both threads terminate on a radially extending bearing flange of the housing part or housing flange, the external thread situated on the device side being provided for fastening the housing part in the electric device, and the external thread situated opposite serving to hold the union nut.

In an alternative embodiment, it is possible to dispense with the thread of the housing part on the device side. This part instead, being of pluggable design and capable of being bonded on the device side or of being fastened to the device housing by means of a clamping ring. In another embodiment, the housing part or the housing flange is connected in one piece to the cover of the electric device, with the result that the holding thread for the union nut is likewise designed as one piece with the device housing. In principle, the devices mentioned can also be electric connectors.

In another embodiment of the invention, the housing part or the housing flange has on its radial inner contour at least one coding piece or key which, for the purpose of assigning positions and the insulation piercing connecting devices, corresponds to a recess in the insulating part as mating component. This coding device expediently comprises a camber portion, projecting on the inner side wall in the holding region of the housing part, and a corresponding groove on the insulating part. The coding device prevents the insulating part from being inserted in a wrongly rotated fashion, something which would be possible in principle given the positioning of the insulation piercing connecting devices in the housing part. Moreover, this coding device prevents a tangential transition of force onto the insulation piercing connecting devices, which could cause the contact made to be impaired by friction between the union nut and the pressure member or sealing member and corresponding transmission onto the conductor cable and the insulating part. The axial alignment of the coding piece of the coding device is dimensioned such that given an unsuitable position of the coding elements of the housing flange or of the housing part and the insulating part, this insulating part cannot be joined, and thus the axially projecting insulation piercing connecting devices cannot be bent. It is thus impossible for an unsuitable position of the insulating part for the union nut to be screwed onto the thread of the housing part or of the housing flange. Finally, at its outside diameter the insulating part is constructed, by means of a groove or a groove segment, in such a way that its outer contour can be joined and plugged in a fashion aligned as mating component to the coded inner contour of the housing part or housing flange.

In order to hold the conductor wires of the low-pole cable, the insulating part has on its end face an opening which is continued in the feed-through openings, which extend with a corresponding axial component at an angle leading obliquely outward and which merge into tube-shaped recesses or positioning openings which extend in an axially parallel fashion and terminate at the opposite end face of the insulating part. The inserted conductor wires are thereby brought into the position required for the coaxially aligned insulation piercing connecting devices and spread at a central splicing element with respect to the insertion opening of the insulating part. Provided on the obliquely extending inner contour of these feed-through openings or guide tubes are stress-relieving grooves which, upon joining of the insulation piercing connecting devices and the insulating part act as anti-slip means and stress-relieving means by supporting themselves on the insulation of the conductor wires to prevent the conductor wires from being pressed or drawn out rearwardly, or conversely by forming an anti-slip support for the respective individual wires.

Provided in the opposite end face, facing the housing flange of the insulating part in accordance with the arrangement of the insulation piercing connecting devices there are opening slots of axially extending recesses which, according to the invention, are crossed by feed-through openings for the individual wires in the insulating part. When joining takes place, the insulation piercing connecting devices are inserted through the opening slots into these recesses and come with their cutting edges into contact with the respective, obliquely crossing individual wires by severing the insulation.

In one embodiment of the invention, the union nut has a cylindrical internal thread and, in the region of the feed-through bore for the conductor cable, preferably a spherically rounded inner region on which there is supported a crown-shaped pressure ring for deforming the sealing ring, which can be plugged onto the outer sheath of the conductor cable. As a result, this pressure ring can be deformed in an anti-slip fashion to seal the cable terminal element tightly against dust and water. In another embodiment, a cylindrical shoulder of axial alignment can be provided for holding a cylindrical sealing ring, a second, axially sealing ring providing a seal towards the thread of the union nut.

In a further embodiment of the invention, positioning openings, extending in an axially parallel fashion, at the end remote from the insertion opening adjoin the feed-through openings in the insulating part, which extend at an acute angle to the longitudinal axis. Furthermore, the housing part is advantageously essentially a hollow cylinder and the insulating part, which can be inserted into the holding bore thereof, is essentially cylindrical. In order to be able to exert as uniform a pressure as possible on the insulating part, the union nut, furthermore, advantageously has a shoulder which projects in the joining direction and has an end face which acts uniformly on the insulating part.

BRIEF DESCRIPTION OF THE DRAWINGS

Other important objects and advantages of the present invention will be apparent from the following detailed description, taken in connection with the accompanying drawings, in which.

DETAILED DESCRIPTION OF THE INVENTION

With reference to the drawings, wherein like reference numbers designate like or corresponding parts throughout, there is shown in FIGS. 1–5 a cable connector 1 made in accordance with the present invention.

Figure 1:
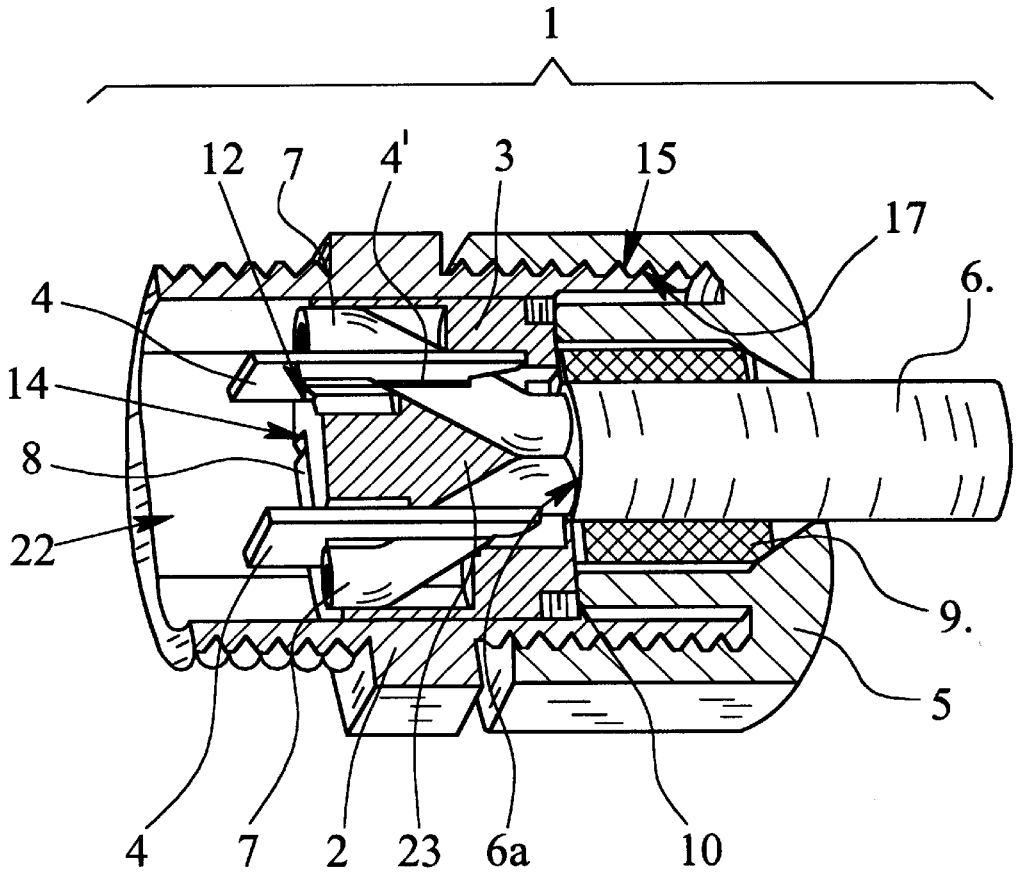
FIG. 1 is an overall perspective view, partially in cross-section, showing a cable connector according to the present invention.

FIG. 1 shows a completely assembled cable connector 1 having a housing flange or housing part 2, which can preferably be screwed on and which can be connected to an electric device. The housing flange or the housing part 2 has a holding bore 22 in which an inwardly projecting coding key camber pad portion 8 is arranged. Arranged in the holding bore 22 of the housing part 2 are insulation piercing connecting devices 4, which are connected thereto and are spatially separated from one another and aligned in an axially parallel fashion. Inserted into the holding bore 22 of the housing part 2 is an insulating part 3 which has a groove segment 14 which accepts the coding key pad 8 of the housing part 2. Inserted into the insulating part 3 are individual wires 7 of a low-pole, round conductor cable 6, which are located, in each case, in a position which makes contact with the insulation piercing connecting devices 4. The outer insulation 6*a* of the conductor cable 6 is moved over a short axial length so that the insulated individual wires 7 can be inserted into the insulating part 3. The housing flange or the housing part 2 has an external thread 15 onto which union nut 5, having a cylindrical internal thread 17, can be screwed. FIG. 1 also shows seals 9 and 10 which seal the cable connector 1 against the intrusion of dust and moisture both axially and radially.

Figure 2:
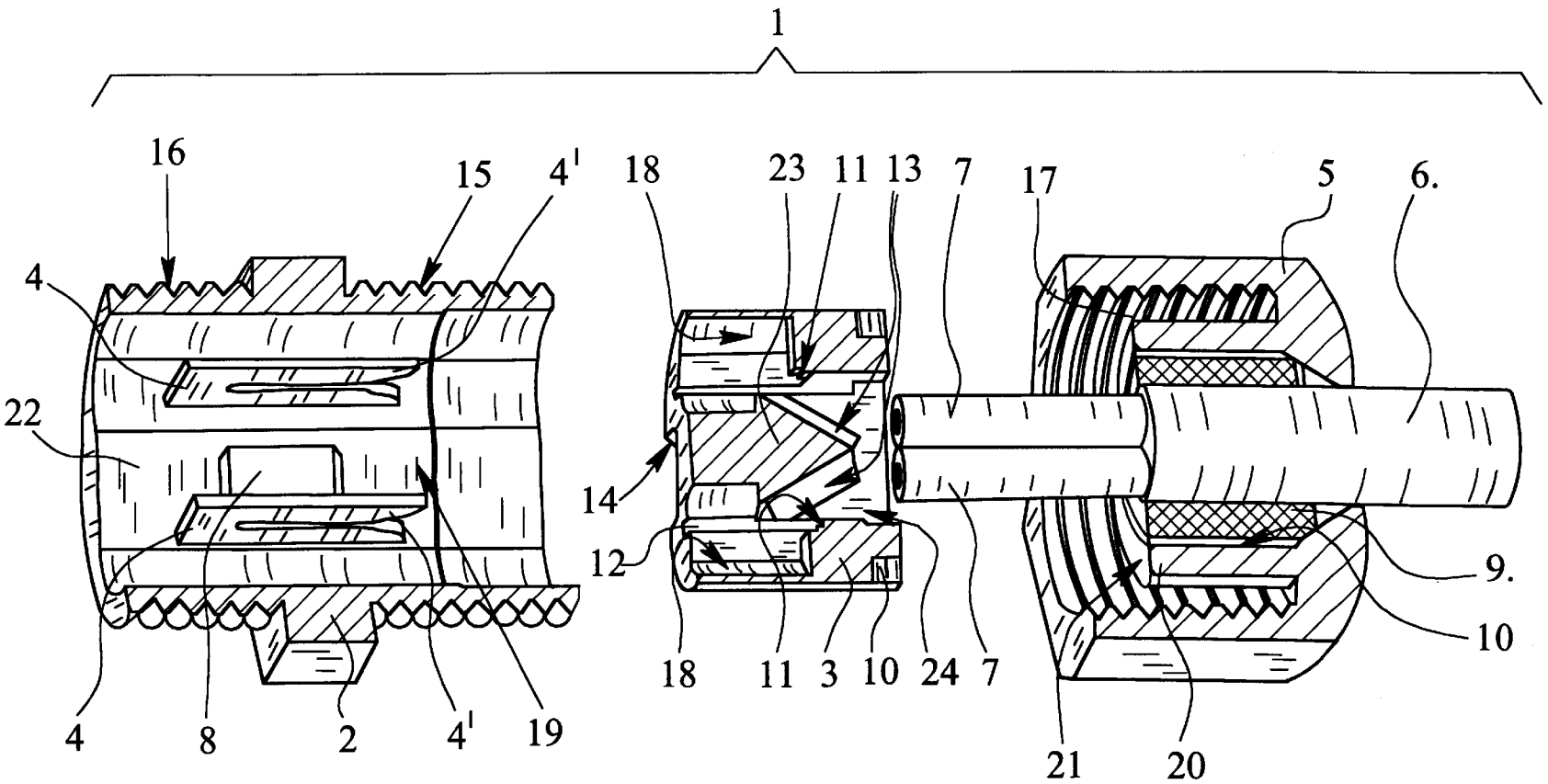
FIG. 2 is an exploded view of the cable connector of FIG. 1.
Figure 3:
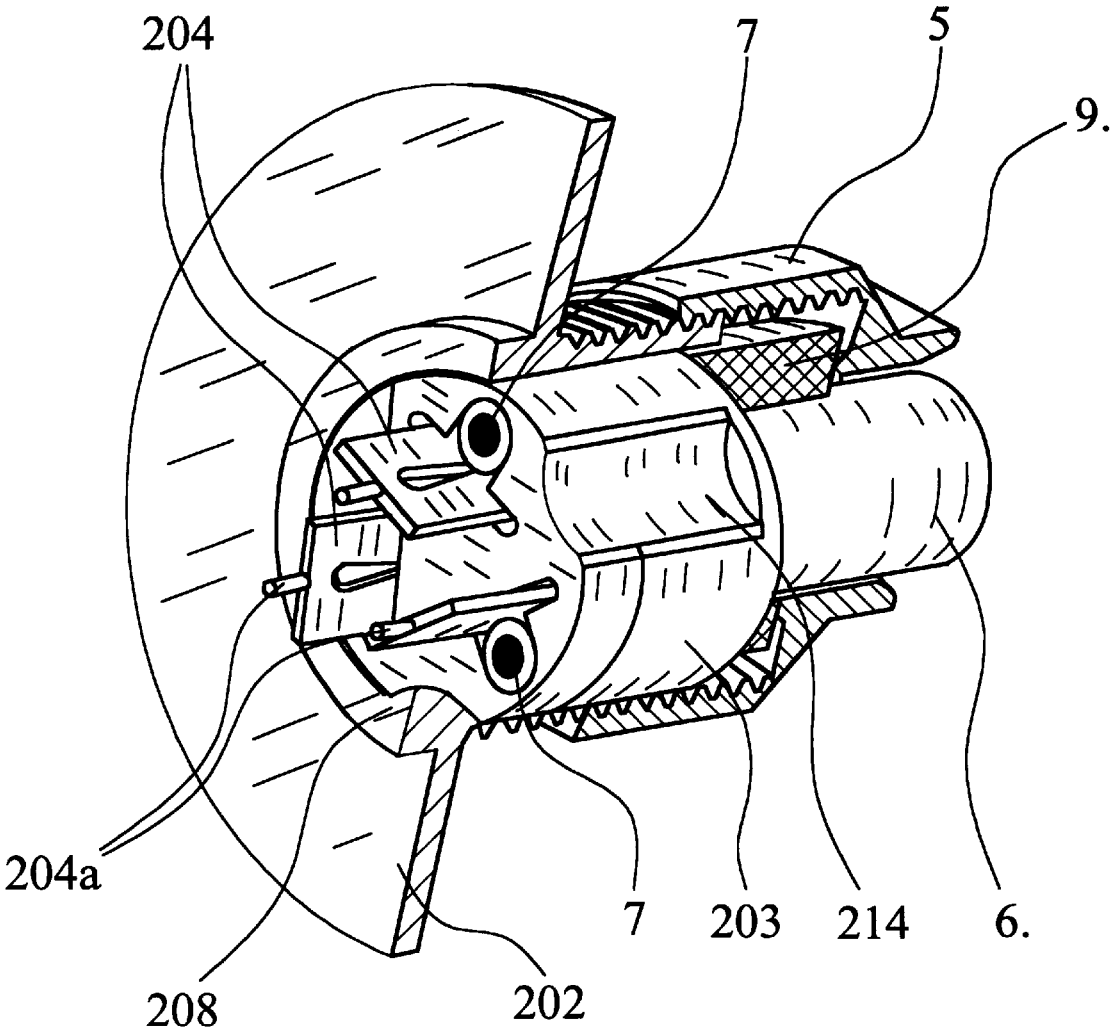
FIG. 3 is a perspective view of the cable connector of FIG. 1, partially in cross-section, in which the insulating portion of cable connector is shown unsectioned.
Figure 4:
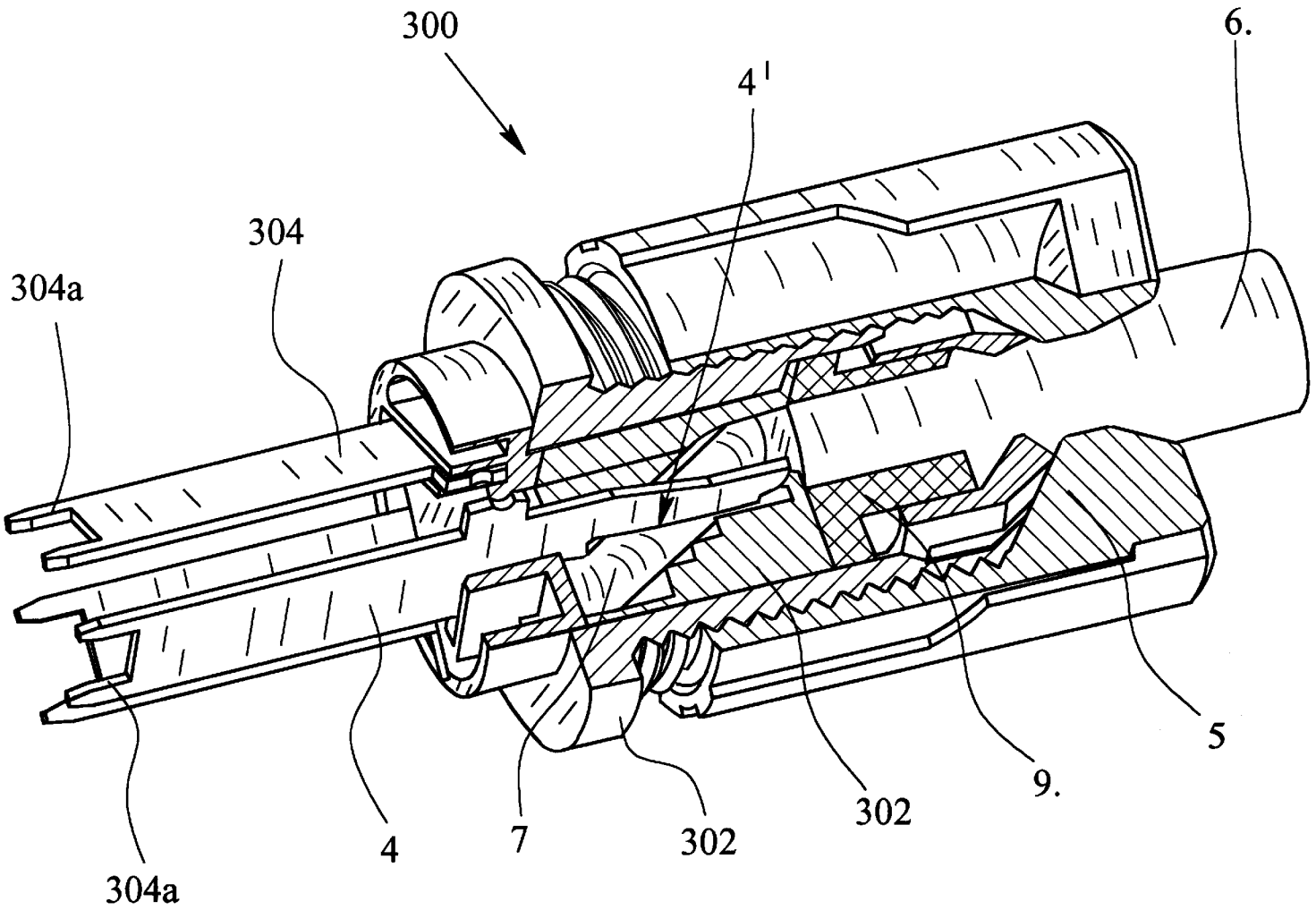
FIG. 4 is an overall perspective view of an alternative embodiment of the cable connector of FIG. 1, with portions shown cut away to reveal details of internal construction.

FIG. 2 shows a disassembled cable connector 1 in accordance with FIG. 1. FIG. 2 clearly shows the shape and position of the coding key pad 8 on the inner surface of the housing part 2, which is located in the holding region 19 of the holding bore 22 of the housing part 2. The coding key pad 8 can be joined to a corresponding mating component, preferably a recess, designated as a groove segment 14, on the insulating part 3. The insulation piercing connecting devices 4, which can be permanently connected to an electric unit, each have a slot-shaped cutting edge 4' which is fitted with a conductor wire insertion region opening in a V-shaped fashion. As shown in FIGS. 3 and 4, the insulation piercing connecting devices 4 can be connected in a pluggable or solderable fashion to an electrical unit such as a socket, a printed circuit board or a similar electrical unit. The insulating part 3 includes feed-through openings 13 for the insulated individual wires 7, which extend at an acute angle, that is to say obliquely relative to the longitudinal axis of the cable terminal element 1. The feed-through openings 13, which can also be designated as guide tubes, each have an integrated anti-slip means 11 which serves as stress-relieving means for the individual wires 7 being held. Adjoining the feed-through openings 13 are positioning openings 18 which extend in an axially parallel fashion and hold the ends of the individual wires 7 as is shown in FIG. 1.

The insulating part 3, in addition, has recesses 12, which extend axially or in an axially parallel fashion and serve the purpose of holding insulation piercing connection devices in a pluggable fashion in the holding bore 22 of the housing part 2. Connecting devices 4 are likewise aligned axially or in an axially parallel fashion. Each feed-through opening 13 is respectively assigned one of the axially extending recesses 12 in the insulating part 3, and crosses recess 12, as is shown in FIG. 2.

Also shown in FIG. 2 is an axially and radially acting sealing ring 10, which is plugged onto one of the end faces of the insulating part 3. The union nut 5, which can be screwed with its cylindrical internal thread 17 onto the external thread 15 of the housing part 2, has an axially projecting, cylindrical shoulder 20, which serves to guide the cylindrical axial and radial seal 9 in a radial fashion. The single-strand or multi-strand low-pole conductor cable 6 having the inner individual wires 7 is guided through this seal 9. The shoulder 20 of the union nut 5 also has an end face 21 which acts uniformly on the insulating part 3 during the joining operation.

As shown in FIGS. 1 and 2, the insulating part 3 has a central splicing element 23 which bounds the obliquely extending feed-through openings 13. The splicing element 23 divides or spreads the individual wires 7 of the conductor cable 6 so that these can be threaded automatically into the obliquely extending feed-through openings 13. As FIG. 2 shows, the central splicing element 23 is situated opposite a central insertion opening 24 on the end face of the insulating part 3 on the insertion side.

FIG. 3 shows an alternative embodiment in which the cable connector 200 has an arrangement of three insulation piercing connecting devices 204 which have solder pins 204*a* for fastening purposes. The groove segment 214 of the insulating part 203 has a rounded cross section in FIG. 3. The coding projections 208 on the inside of the housing part 202 are correspondingly constructed to complement the rounded cross-section. The housing flange or the housing part 202 is designed to be pluggable for an adhesive connection.

FIG. 4 shows another pluggable and adhesive embodiment of the invention 300 in which the housing flange, or the housing part 302, of the cable connector 300 has been modified. The insulation piercing connecting devices 304 are arranged in a threefold combination and project out of the housing part 302 and form lengthened contacts 304*a* for soldered fastening to a printed circuit board.

Figure 5:
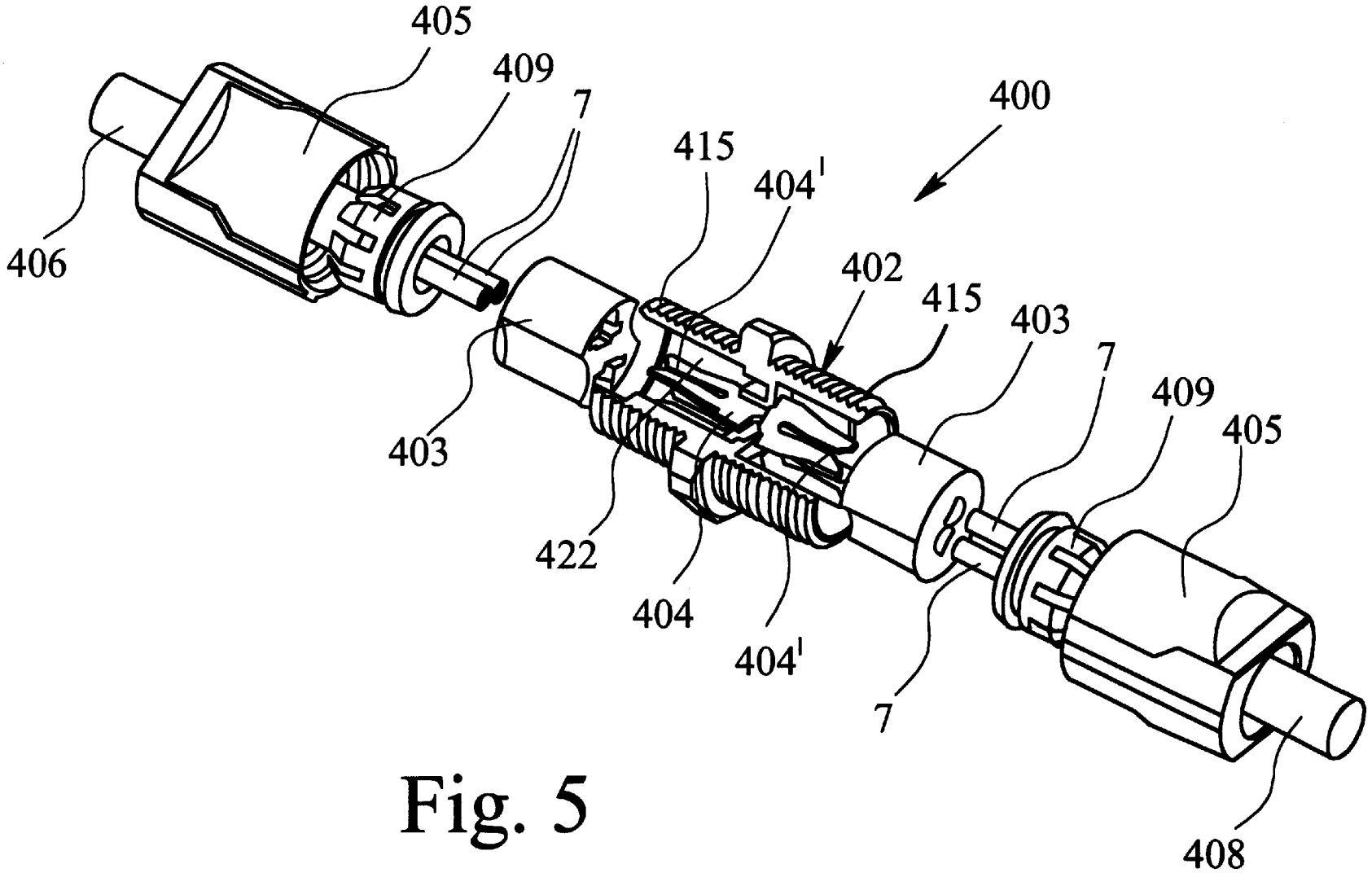
FIG. 5 is an exploded view of another embodiment of the cable connector of FIG. 1, with portions shown cut away to reveal details of internal construction.

FIG. 5 shows another embodiment of the invention 400 in which the cable connector 400 permits a double-ended connection of a cable, that is to say the cable connector 400 can be used to connect two cables 406, 408. Insulation piercing connecting devices 404, having cutting edges 404' at both ends, are correspondingly arranged in the holding bore 422 of the housing part 402 and insulating parts 403 can be inserted into the housing part 402 from both end faces of the holding bore of the housing part 402. Furthermore the housing part 402 has external threads 415 towards both ends, in order to be able to hold, at both ends, a union nut 405 having a sealing element 409.

The foregoing specific embodiments of the present invention as set forth in the specification herein are for illustrative purposes only. Various deviations and modifications can be made within the spirit and scope of this invention, without departing from the main theme thereof.

We claim:

1. A cable connector for electrical cables comprising:

a housing having an axial bore;

a plurality of terminal contacts disposed in said housing, with said terminal contacts each comprising insulation piercing means, having cutting edges; with said insulation piercing means aligned generally axially with respect to said housing bore;

an insulating part, with said insulating part disposed coaxially in said axial bore; with said insulating part having axially extending recesses receiving said insulation piercing means;

with said insulating part having obliquely extending feed-through openings for feeding an unstripped individual wire;

a central splicing element, disposed in said insulating part, which holds said unstripped individual wire in position relative to said insulation piercing means;

anti-slip means disposed on said obliquely extending feed-through openings;

union nut means for fastening and sealing, with said union nut means disposed threaded onto said housing while driving said insulation part, with said axial bore defining an axial direction relative to said connector and with a direction perpendicular to said axial direction defining a radial direction;

a flexible seal member; and a pressure member having a plurality of arms and disposed bearing on said seal member causing said seal member to bear against said electrical cable in the axial direction and in the radial direction thereby providing both stress relief for said electrical cable and an environmental seal.

2. The cable connector as claimed in claim 1, further comprising positioning openings formed in said insulating part, with said positioning openings extending in a generally axial parallel orientation and communicating with said obliquely extending feed-through openings.

3. The cable connector as claimed in claim 1, wherein said anti-slip means comprises a plurality of stress relieving grooves.

4. The cable connector as claimed in claim 1, wherein said housing is generally cylindrical and wherein said insulating part is generally cylindrical.

5. The cable connector as claimed in claim 1, wherein said union nut means comprises a shoulder portion and an end face which bears uniformly on said insulating part.

6. A cable connector for electrical cables comprising:

a housing having an axial bore;

a plurality of terminal contacts disposed in said housing, with said terminal contacts each comprising insulation piercing means, having cutting edges; with said insulation piercing means aligned generally axially with respect to said housing bore;

an insulating part, with said insulating part disposed coaxially in said axial bore, with said insulating part having axially extending recesses receiving said insulation piercing means;

with said insulating part having obliquely extending feed-through openings for feeding an unstripped individual wire;

a central splicing element, disposed in said insulating part, which holds said unstripped individual wire in position relative to said insulation piercing means;

anti-slip means disposed on said obliquely extending feed-through openings;

union nut means for fastening and sealing, with said union nut means disposed threaded onto said housing while driving said insulation part;

with said axial bore defining an axial direction relative to said connector and with a direction perpendicular to said axial direction defining a radial direction;

a flexible seal member; and a pressure member having an angular surface causing said seal member to bear against said electrical cable in the axial direction and in the radial direction, thereby providing both stress relief for said electrical cable and an environmental seal.

* * * * *